US006702623B2

(12) United States Patent
Fukuda et al.

(10) Patent No.: US 6,702,623 B2
(45) Date of Patent: Mar. 9, 2004

(54) CONNECTOR

(75) Inventors: Masaru Fukuda, Shizuoka (JP); Takeya Miwa, Shizuoka (JP); Shinji Mochizuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/152,797

(22) Filed: May 23, 2002

(65) Prior Publication Data

US 2002/0177371 A1 Nov. 28, 2002

(30) Foreign Application Priority Data

May 25, 2001 (JP) ..... P2001-157409

(51) Int. Cl.[7] ..... H01R 13/514
(52) U.S. Cl. ..... 439/701; 439/595
(58) Field of Search ..... 439/687, 696, 439/660, 688, 865, 867, 701

(56) References Cited

U.S. PATENT DOCUMENTS 3,474,398 A * 10/1969 Piorruneck ..... 439/871
3,544,954 A * 12/1970 Yeager ..... 439/871
4,717,359 A * 1/1988 Rahrig et al. ..... 439/595
5,888,103 A * 3/1999 Norizuki et al. ..... 439/701
6,179,670 B1 * 1/2001 Sugiyama ..... 439/701
6,231,398 B1 * 5/2001 Furutani et al. ..... 439/701
6,231,400 B1 * 5/2001 Nagai ..... 439/701
6,358,098 B1 * 3/2002 Wakata ..... 439/701

FOREIGN PATENT DOCUMENTS

JP 10-189117 7/1998
JP 11-144786 5/1999

* cited by examiner

*Primary Examiner*—Hien Vu
(74) *Attorney, Agent, or Firm*—Sughrue Mion, PLLC

(57) ABSTRACT

A connector (1) is configured in a manner that two stages of insulation housings (23) are disposed therein each of which is additionally provided with common terminal chambers (28) each capable of housing a crimp-style terminal or a crimped terminal (25) or a press contact terminal (26) thereby to house the crimped terminals (25) and the press contact terminals (26) in a mixed manner within the connector. The common terminal chambers (28) of each of the insulation housings (23) are formed by partition walls (29) erected from a base plate portion (27), and the crimped terminal (25) or the press contact terminal (26) is inserted from the upper opening of each of the common terminal chambers (28). The upper openings of the common terminal chambers (28) of the insulation housing (23) at the lower stage are covered by the base plate portion (27) of the insulation housing (23) at the upper stage, and the upper opening of the insulation housing (23) at the upper stage is covered by the cover main body (31*a*) of a cover member (31).

6 Claims, 9 Drawing Sheets

CONNECTOR

The present invention is based on Japanese Patent Application No. 2001-157409, which is incorporated herein by reference.

BACKGROUND OF THE INVENTION

1. Field of the Invention

The present invention relates to a connector which is configured in a manner that one or plural stages of insulation housings are disposed therein each of which is additionally provided with common terminal chambers each capable of housing a crimp-style terminal or a crimped terminal or a press contact terminal thereby to house the crimped terminals and the press contact terminals in a mixed manner within the-connector.

2. Related Art

In recent years, in accordance with the increase of the number of electric devices and control circuits etc. mounted on an automobile, the number of electric wires to be housed in a wiring harness wired within a body of the automobile has been increased. In such a wire harness having many electric wires to be housed, such a connector has been increasingly employed that houses and holds press contact terminals which are excellent in workability of coupling the end portions of the electric wires.

The press contact terminal is configured in a manner that when a covered electric wire is inserted with pressure between a pair of press-contact blades disposed in an opposite manner, the press-contact blades cut the insulation cover of the covered wire and are made in contact with the inner conductor of the covered wire and so electrically coupled to the inner conductor of the covered wire. As compared with the conventionally spread crimped terminals, such a press contact terminal can eliminate a process of stripping off the cover of the end portion of the electric wire and a process of caulking the terminal, and hence the workability of coupling the electric wires can be improved to a large extent However, the press contact terminal is restricted in the kinds of electric wires capable of being coupled thereto due to the configuration thereof. For example, the press contact terminal is not suitable for a covered electric wire in which the outer diameter of the inner conductor thereof is out of the prescribed range with respect to a gap size between the pair of the press-contact blades, for a shield electric wire in which a shield wire is disposed on the outer periphery of the inner conductor, and for an electric wire requiring a high coupling intensity.

In general, the wire harness for an automobile contains various kinds of cover electric wires and shield electric wires etc. having different sizes, and so it is required, in view of productivity, to use properly electric wires to be coupled to the press contact terminals and electric wires to be coupled to crimped terminals like the conventional technique.

In view of such a mixed usage of the press contact terminals and the crimped terminals, such a connector is proposed which is configured in a manner that one or plural stages of insulation housings are disposed therein each of which is additionally provided with common terminal chambers each capable of housing a crimp-style terminal or a crimped terminal or a press contact terminal thereby to house the crimped terminals and the press contact terminals in a mixed manner within the connector FIGS. 9 to 11 show an example of conventional connector housing the crimped terminals and the press contact terminals in a mixed manner.

A connector 1 shown in the figures is disclosed in Japanese Patent Laid-Open No. 189117/1998 and is configured in a manner that common terminal chambers 8 commonly usable for crimped terminals 5 and press contact terminals 6 are disposed in two lines of upper and lower stages in a mixed manner within an insulation housing 3.

Each of the crimped terminals 5 and the press contact terminals 6 is a press molded part formed by a metal conductor plate.

As shown in FIG. 10, the press contact terminal 6 is configured in a manner that two pairs of press-contact blades 6*a*, 6*a* each pair of which cut the outer cover of a covered electric wire 13 and are made in contact with the inner conductor of the electric wire are disposed at the rear end portion of the terminal in an opposite manner and a female terminal fitting portion 6*c* into which a coupling male terminal of a partner side is fitted is disposed at the front end portion of the terminal.

As shown in FIG. 11, the crimped terminal 5 is configured in a manner that a conductor caulking nail. 5*a* for making press-contact with the inner conductor of a covered electric wire 12 and a cover caulking nail 5*b* for pressing the covered electric wire 12 on the outer cover thereof are disposed at the rear end portion of the terminal and a female terminal fitting portion 5*c* into which a coupling male terminal of a partner side is fitted is disposed at the front end portion of the terminal.

The common terminal chamber 8 is provided at the rear half portion thereof with an opening which makes a pair of the press-contact blades 6*a*, 6*a* of the rear end portion possible to press-contact with the covered electric wire 13 of the terminal after the press contact terminal 6 is housed within the common terminal chamber. Covers 9, 10 for shielding the opening are integrally formed with the insulation housing 3 by thin-thickness hinges 11 at the front side from the opening, respectively.

The front half portion of the common terminal chamber 8 houses the terminal fitting portions 5*c*, 6*c* of the crimped terminal 5 and the press contact terminal 6 and has therein flexible lances 3*a*, 3*b* for provisionally engaging these terminals 5, 6.

The press contact terminal 6 and the crimped terminal 5 are inserted from the rear side of the common terminal chambers 8 toward the front side of the insulation housing 3 as shown by arrows A, B in FIGS. 10 and 11, respectively, and provisionally engaged with the flexible lances 3*a*, 3*b* within the common terminal chambers 8.

As shown in FIG. 10, in the press contact terminals 6, the covered electric wires 13 are made in contact with pressure to the press-contact blades 6*a*, 6*a* from direction shown by arrows C, D, respectively. As shown in FIG. 11, the covered electric wires 12 are made in contact with pressure to the crimped terminals 5 in advance.

Thereafter, the open/close covers 9, 10 are closed and so both the crimped terminals and the press contact terminals 6 are placed in a formally engaged state, whereby the crimped terminals 5 and the press contact terminals 6 are prevented from coming out of the common terminal chambers.

As shown in FIG. 9., the open/close covers 9, 10 thus closed engage with engaging lock portions 3*c*, 3*d* protrusively provided at the outer side surface of the insulation housing 3 and so are locked in a closed state, respectively.

However, according to the aforesaid conventional connector 1, the terminals 5, 6 are attached to the common terminal chambers 8 by inserting the terminals from the rear side of the insulation housing 3.

Thus, the terminals 5, 6 which are inserted along the longitudinal direction of the terminals upon insertion are apt to vibrate, so that there is a possibility that the front end portions etc. of the terminals collide with the inner wall surfaces of the common terminal chambers 8 due to the vibration of the terminals and so the insertion operation of the terminals can not be performed smoothly.

Further, the insertion direction (the direction shown by the arrows A, B in FIGS. 10, 11) of the crimped terminals 5 and the press contact terminals 6 with respect to the common terminal chambers 8 on the insulation housing 3 differs from the directions (the directions shown by the arrows C, D in FIG. 10) of the press-contact operation of the covered electric wires 13 with respect to the press contact terminals 6. Thus, it is difficult to automate a mounting process of the crimped terminals 5 and the press contact terminals 6 on the insulation housing 3 and a press-contact process of the covered 6 electric wires 13 with respect to the press contact terminals 6, whereby there arises a problem that the workability of the assembling process for the connector 1 is not good.

Accordingly, an object of the invention is to obviate the aforesaid problems of the conventional technique, and to provide a connector which can house crimped terminals and press contact terminals in a mixed manner, and enhance the workability of the inserting operation of the respective terminals within common terminal chambers to improve the workability of the assembling operation of the connector thereby to reduce a cost of the connector.

SUMMARY OF THE INVENTION

The aforesaid object of the invention is attained by a connector comprising:

- one or plural stages of insulation housings, each of which includes a base plate portion and partition walls which are erected from the base plate portion, thereby forming a plurality of common terminal chambers;
- each of the common terminal chambers being configured to be capable of accommodating a crimped terminal or a press contact terminal;
- crimped terminals and press contact terminals accommodated in a mixed manner within the insulating housings;
- wherein openings of the common terminal chambers through which the crimped terminal or the press contact terminal is inserted are formed on one side surface of each insulating housing; and
- the insulation housings are stacked and a cover is provided on one of the insulating housings at an end of stacking of the insulating housings so as to cover this insulating housing.

According to the aforesaid configuration, the crimped terminal or the press contact terminal is inserted from the upper opening of the common terminal chamber.

Thus, when compared with the conventional connector in which the crimped terminal or the press contact terminal is inserted within the common terminal chamber from the rear side opening along the longitudinal direction of the terminal, according to the connector of the invention, the size of the opening is large and so the terminals can be inserted easily through the openings. Thus, there does not arise such a phenomenon that the front end portion of the terminal collides with the inner wall of the common terminal chamber due to the vibration of the terminal upon insertion thereof.

Further, the insertion direction of the crimped terminals or the press contact terminals with respect to the common terminal chambers coincides with the direction of the press-contact operation of the covered electric wires with respect to the press contact terminals. Thus, it is easy to automate the mounting process of the respective terminals on the insulation housing and the press-contact process of the covered electric wires with respect to the press contact terminals.

Preferably, each of the partition walls of the insulation housing is provided with a terminal engaging portion which engages with a housing engaging portion of the crimped terminal or the press contact terminal inserted from the upper opening of each of the common terminal chambers to position the terminal in an axis line direction.

In this case, since the press contact terminal inserted into the common terminal chamber is positioned in the axis line direction by the terminal engaging portion engaged with the housing engaging portion, the terminal is prevented from being deviated in its position at the time of the press-contact process. Further, the respective terminals are prevented from coming out until the terminals are covered by the other insulation housing or the cover member laminated on the insulation housing.

Further, preferably, the housing engaging portion includes an engagement opening formed at a side wall of each of the terminals respectively opposing to the partition walls and a flexible engagement piece formed on a terminal bottom wall side of the engagement opening, and the terminal engaging portion is formed by an engagement projection protrusively provided at each of the partition walls in correspondence to the engagement opening.

In this case, since the engagement projection protrusively provided at each of the partition walls engages with the engagement opening or the flexible engagement piece, the terminals can be positioned within the common terminal chambers respectively.

In the conventional connector, the housed terminal is engaged within the terminal housing portion in a manner that the engagement lance raised at the terminal is engaged with a recess portion formed at the inner wall surface of the terminal housing portion and the flexible lance formed at the inner wall surface of the terminal housing portion is engaged with the opening formed at the terminal. Thus, as compared with such a conventional connector, in the invention, it is possible to make the pitch of the arrangement of the common terminal chambers narrower by thinning the thickness of each of the partition walls defining and forming the respective common terminal chambers and so the connector can be miniaturized easily.

The tensile force acting through the covered electric wires coupled to the terminals can be received by the hooking portions between the engagement projections protrusively provided at the partition walls and the opening edges of the engagement openings into which the engagement projections are fitted. Thus, as compared with the conventional engagement lance and flexible lance, the sufficient terminal engagement force can be easily secured for the insulation housing.

Further, since the flexible engagement pieces do not protrude outside of the side walls of the terminals, there is no possibility that the flexible engagement pieces 43 are caught by other terminals or other members etc. and damaged during the transportation of the terminals. Thus, the connector according to the invention can be treated easily.

BRIEF DESCRIPTION OF THE DRAWING

FIG. 4B is a perspective view of the entirety of the press contact terminal shown in. FIG. 1 seen from the lower surface side thereof;

DETAILED DESCRIPTION OF THE PREFERRED EMBODIMENTS

The connector according to embodiments of the invention will be explained with reference to the accompanying drawings.

Figure 1:
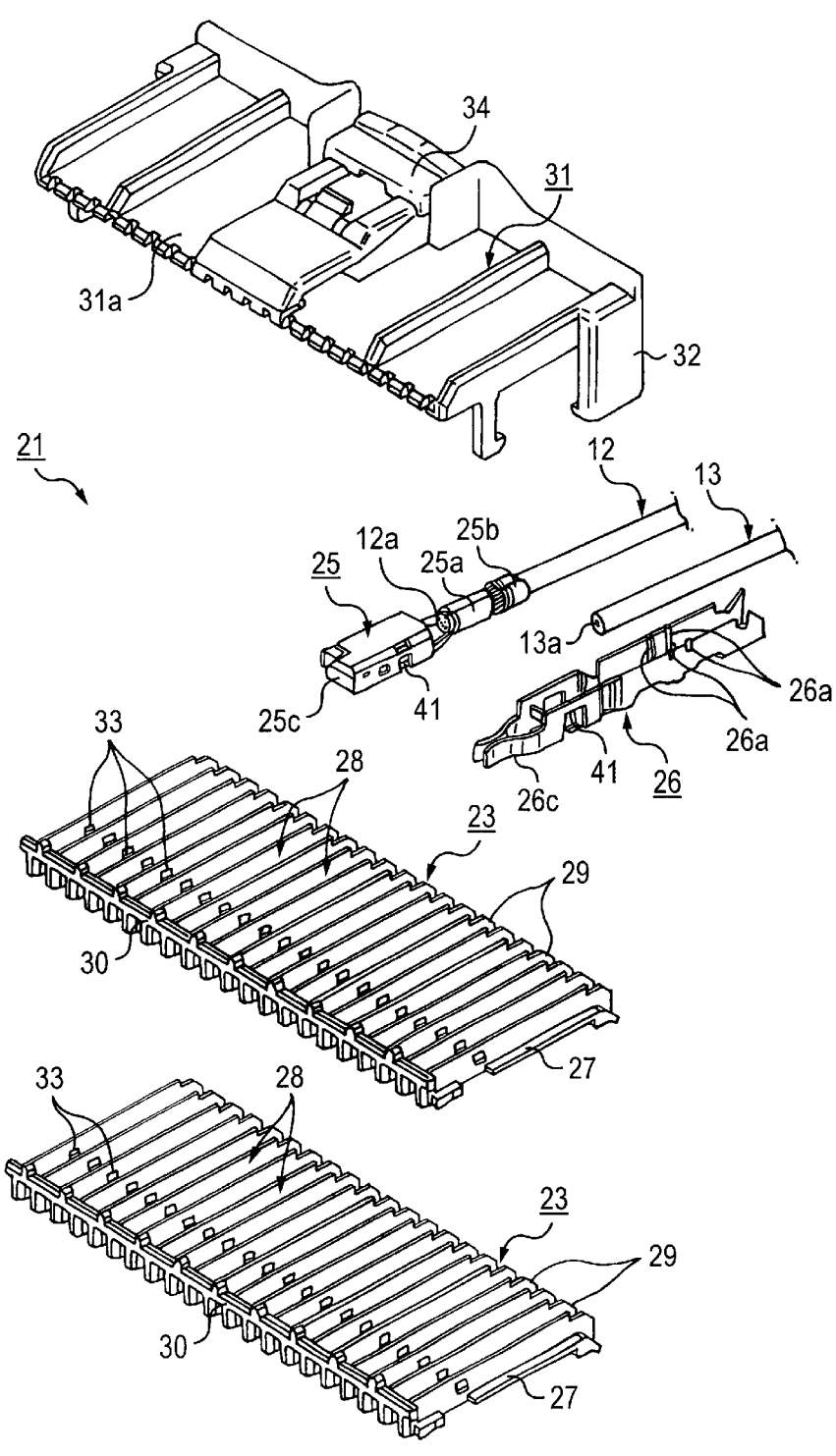
FIG. 1 is an exploded perspective view of the connector according to the first embodiment of the invention.
Figure 2:
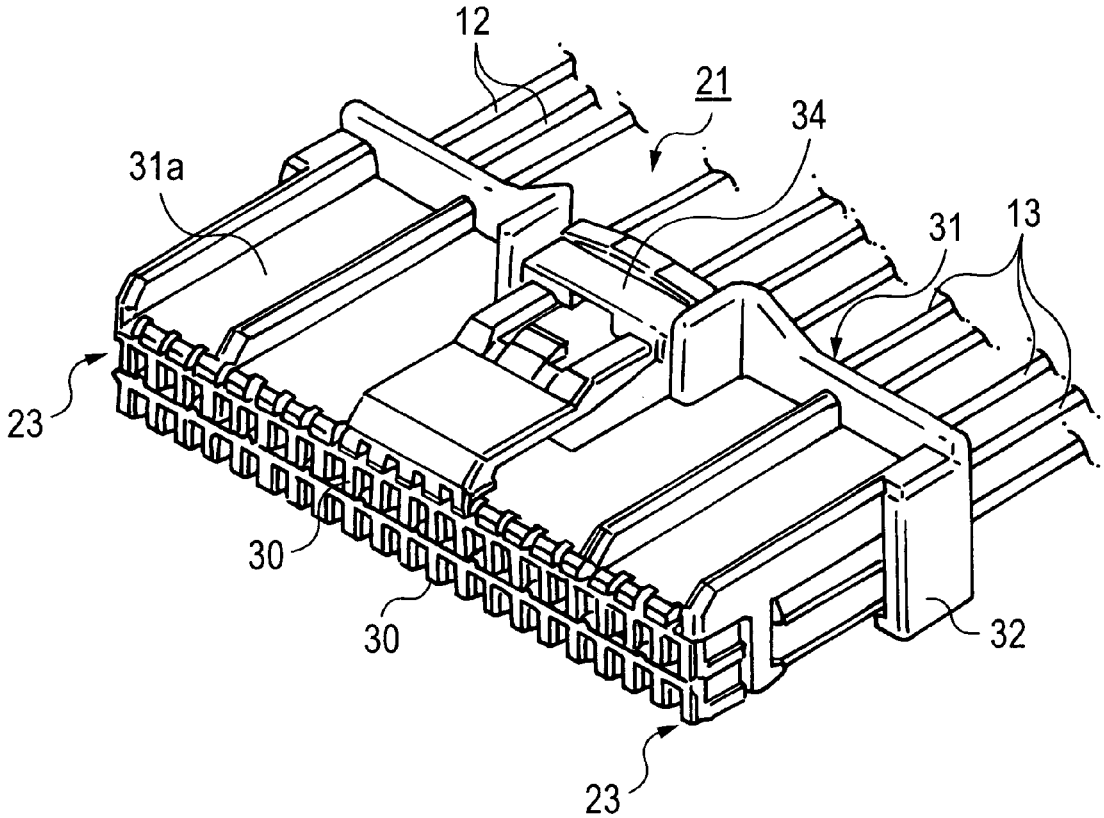
FIG. 2 is a perspective view of the connector in an assembled state shown in FIG. 1.
Figure 3A:
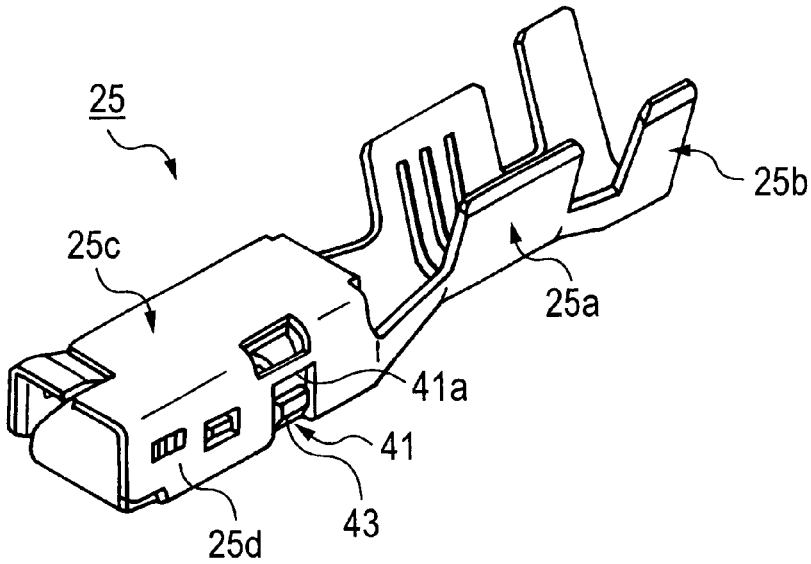
FIG. 3A is a perspective view of an entirety of a crimped terminal shown in FIG. 1 seen from the upper surface side thereof.
Figure 3B:
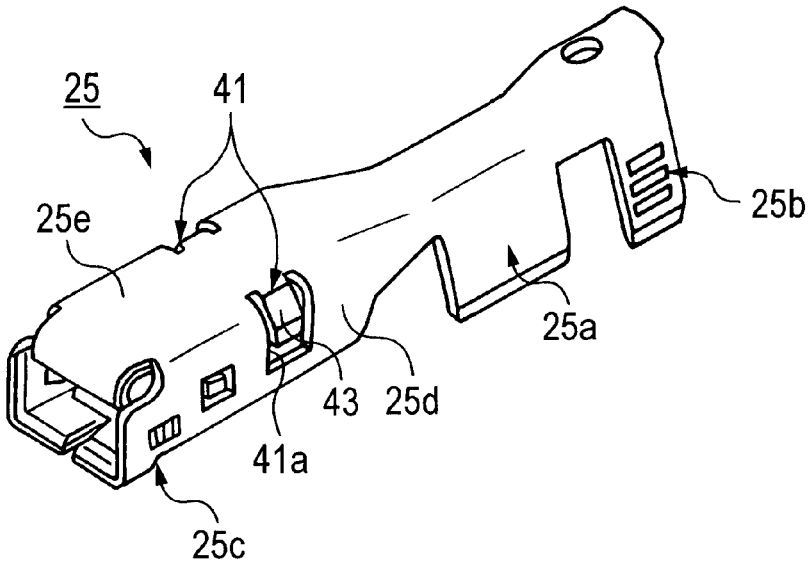
FIG. 3B is a perspective view of the entirety of the crimped terminal shown in FIG. 1 seen from the lower surface side thereof.
Figure 4A:
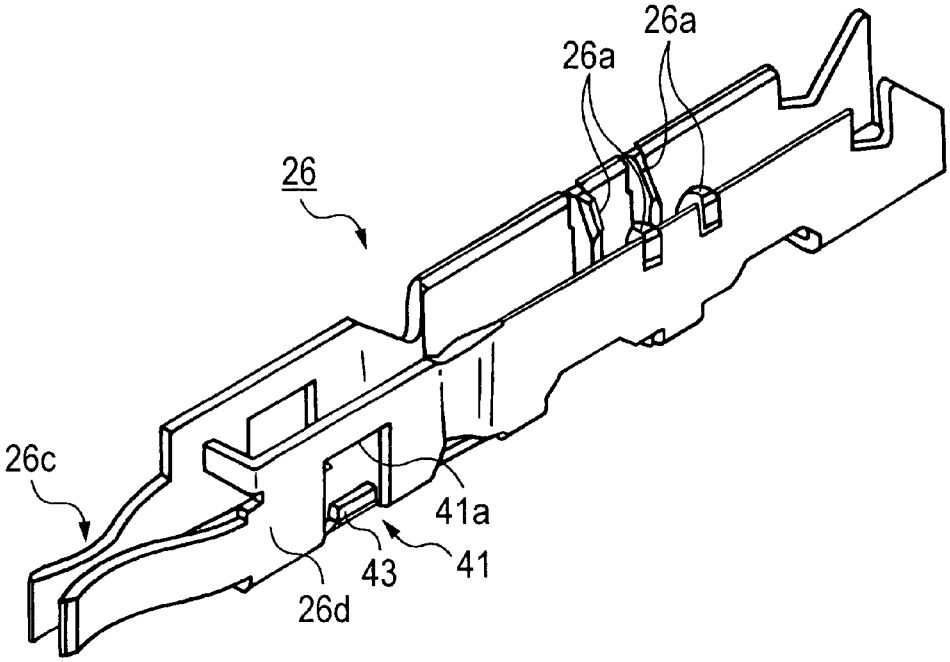
FIG. 4A is a perspective view of an entirety of a press contact terminal shown in FIG. 1 seen from the upper surface side thereof.
Figure 4B:
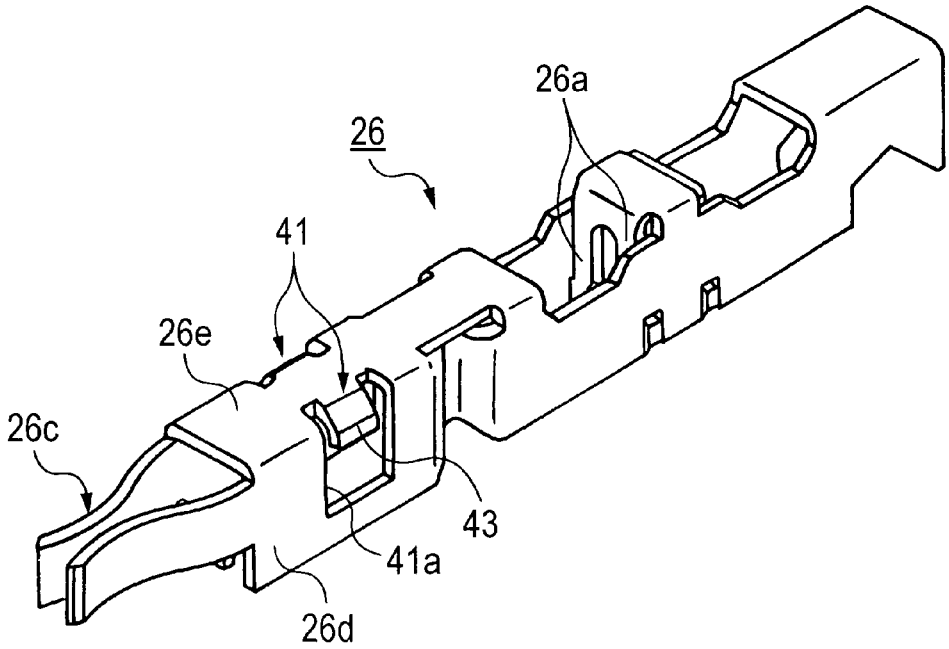
Figure 5:
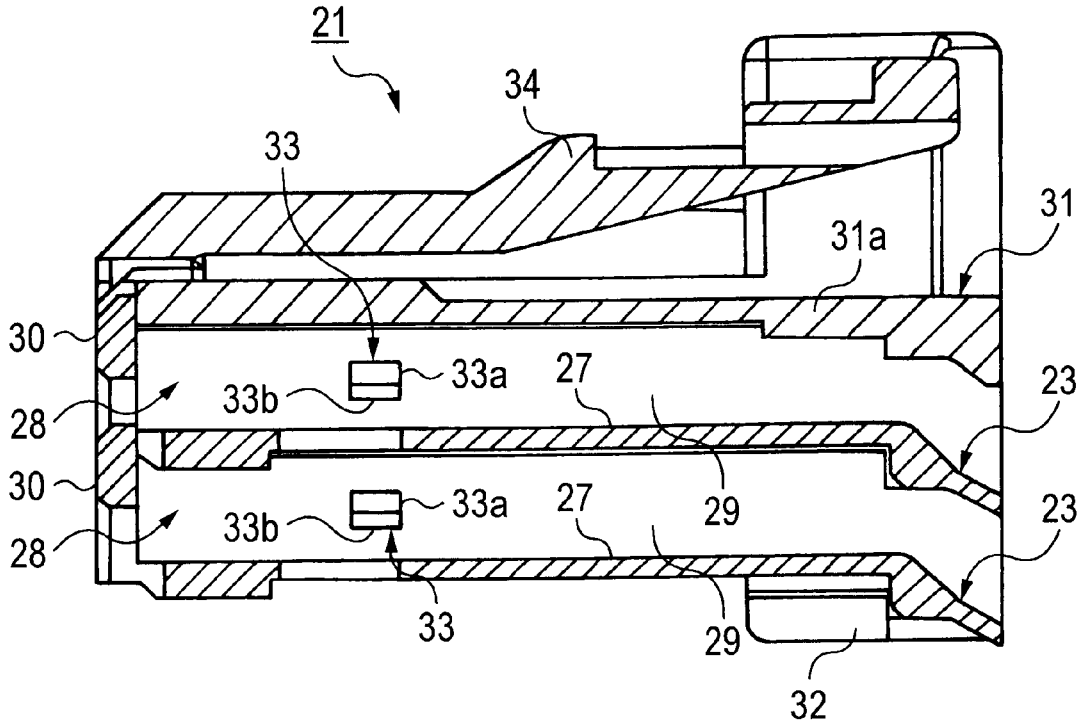
FIG. 5 is a longitudinal sectional view showing a common terminal chamber in a state that a cover member is attached to an insulation housing shown in FIG. 1.
Figure 6A:
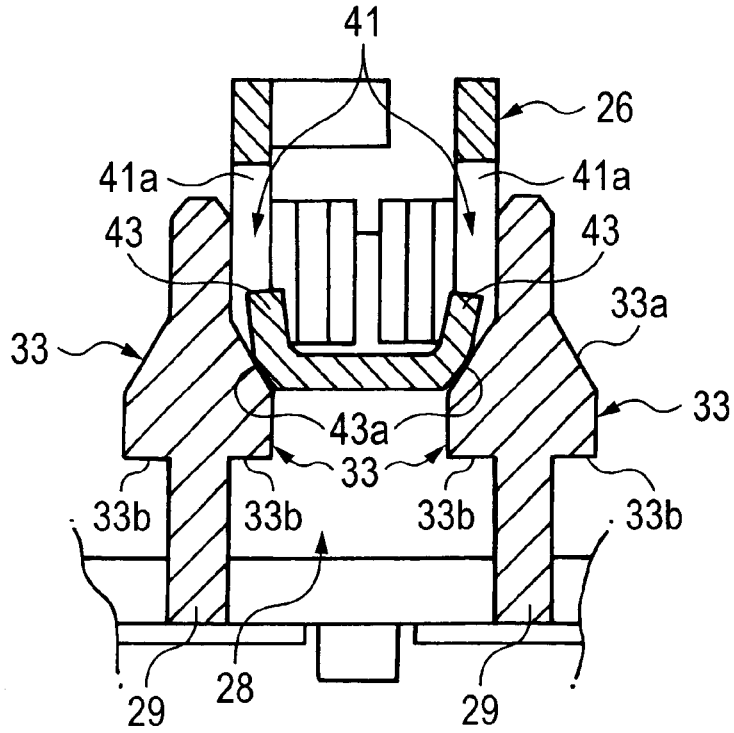
FIGS. 6A and 6B are transversal sectional views of main portions for explaining the attachment operation of the press contact terminal to the common terminal chamber of the connector shown in FIG. 1.
Figure 6B:
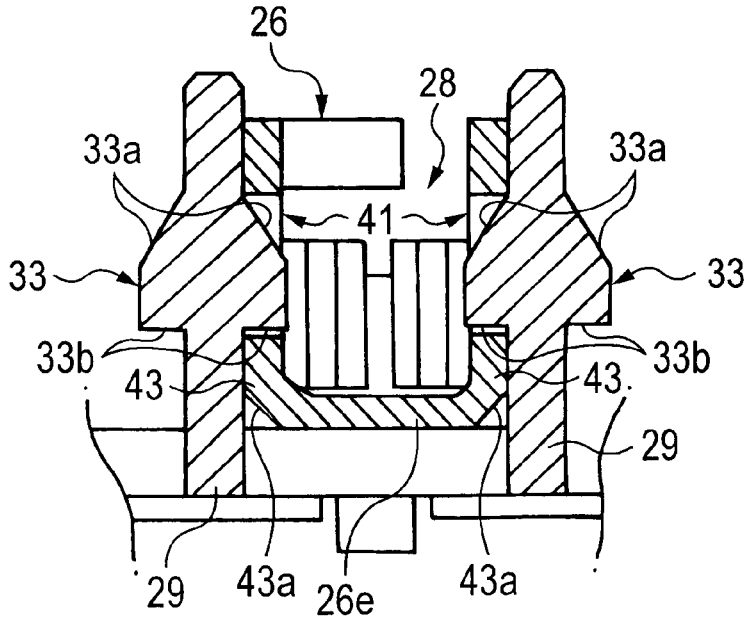

FIG. 1 is an exploded perspective view of the connector according to the first embodiment of the invention, FIG. 2 is a perspective view of the connector in an assembled state shown in FIG. 1, FIGS. 3A and 3B are perspective views of an entirety of a crimped terminal shown in FIG. 1 seen from the upper and lower surface sides thereof, respectively, FIGS. 4A and 4B are perspective views of an entirety of a press contact terminal shown in FIG. 1 seen from the upper and lower surface sides thereof, respectively, FIG. 5 is a longitudinal sectional view showing a common terminal chamber in a state that a cover member is attached to an insulation housing shown in FIG. 1, and FIGS. 6A and 6B are transversal sectional views of main portions for explaining the attachment operation of the press contact terminal to the common terminal chamber of the connector shown in FIG. 1.

The connector 21 according to the first embodiment is developed for a wire harness of an automobile and is configured in a manner, as shown in FIGS. 1 and 2, that two stages of insulation housings 23 are disposed therein each of which is additionally provided with common terminal chambers 26 each capable of housing a crimp-style terminal or a crimped terminal 25 or a press contact terminal 26 thereby to house the crimped terminals 25 and the press contact terminals 26 in a mixed manner within the connector.

Each of the crimped terminals 25 and the press contact terminals 26 is a press molded part formed by a metal conductor plate.

As shown in FIGS. 3A and 3B, the crimped terminal 25 is configured in a manner that a conductor caulking nail 25*a* for making press-contact with the inner conductor of a covered electric wire 12 and a cover caulking nail 25*b* for pressing the covered electric wire 12 on the outer cover thereof are disposed at the rear end portion of the terminal and a female terminal fitting portion 25*c* into which a coupling male terminal of a partner side is fitted is disposed at the front end portion of the terminal.

As shown in FIGS. 4A and 4B, the press contact terminal 26 is configured in a manner that two pairs of press-contact blades 26*a*, 26*a* each pair of which cut the outer cover 13*b* of a covered electric wire 13 and are made in contact with the inner conductor 13*a* of the covered electric wire are disposed at the rear end portion of the terminal in an opposite manner and a female terminal fitting portion 26*c* into which a coupling male terminal of a partner side is fitted is disposed at the front end portion of the terminal.

The insulation housing 23 according to the first embodiment is configured in a manner that the common terminal chambers 28 are defined and formed by partition walls 29 which are erected with a predetermined interval on a lengthy base plate portion 27 and the crimped terminal 25 or the press contact terminal 26 is inserted from an upper opening of each of the common terminal chambers 28. That is, the terminals 25, 26 can be inserted into the common terminal chambers 28 from the same direction (the upper direction in FIG. 1) as that of the press-contact operation of the covered electric wire 13 to the press contact terminals 26.

Incidentally, the insulation housing 23 is integrally formed continuously in a lengthy manner along the arrangement direction of the common terminal chambers 28 in advance and thereafter cut at use into a predetermined length in accordance with a required number of poles. A front wall 30 constituting a terminal insertion port into which a coupling male terminal of a partner side is inserted and guided is integrally formed at the front end side of the insulation housing 23.

The upper openings of the common terminal chambers 28 of the insulation housing 23 at the lower stage are covered by the base plate portion 27 of the insulation housing 23 at the upper stage, and the upper openings of the common terminal chambers 28 of the insulation housing 23 at the upper stage are covered by the cover main body. 31*a* of a cover member 31 which is coupled in a laminated state. Cover lock portions 32 for holding the both side edges of the insulation housings 23, 23 are provided at the both side ends of the cover main body 31*a* of an almost rectangular shape, respectively. A locking arm 34 for fitting to and locking with a partner side connector is provided at the upper surface of the cover main body 31*a*.

The connector 21 according to the first embodiment is configured in a manner that the two insulation housings 23 are piled up in a laminated state thereby to provide the connector with the common terminal chambers 28 of multi-stages in the vertical direction. However, the connector may be configured in a manner that the single insulation housing 23 is arranged in a single stage or the insulation housings 23 are laminated in multi-stages of three stages or more. In this case, it is merely required to suitably change the length of the cover lock portion 32 of the cover member 31 and so the insulation housings 23 can be used commonly.

Further, at each of the both surfaces of each of the partition walls 29 defining and forming the common terminal chambers 28 of the insulation housing 23, an engagement projection 33 serving as a terminal engaging portion is protrusively provided which engages with the housing engaging portion 41 of the crimped terminal 25 or the press contact terminal 26 inserted from the upper opening of the common terminal chamber 28 thereby to position the terminal-in the axis line direction.

As shown in FIGS. 5 and 6, the engagement projection 33 has a slanted surface 33*a* for guiding at the upper surface side of the housing and also has a horizontal surface 33*b* for engagement at the lower surface side of the housing.

As also shown in FIGS. 3 and 4, the housing engaging portions 41 of each of the crimped terminals 25 and the press contact terminal 26 are formed so as to penetrate a pair of terminal side walls 25*d*, 25*d* (26*d*, 26*d*) opposing to the partition walls 29 of the insulation housing 23, and each of the housing engaging portions has an engaging opening 41*a* into which the engagement projection 33 can be inserted and a flexible engagement piece 43 cut and raised so as to erect from the terminal bottom wall 25*e* (26*e*) side of the engagement opening 41*a* along the terminal side wall 25*d* (26*d*).

First, as shown in FIG. 6A, for example, when the press contact terminal 26 is inserted from the upper opening of the common terminal chamber 28 of the insulation housing 23, the flexible engagement pieces 43 of the housing engaging portions 41 abut against the slanted surfaces 33*a* of the engagement projections 33 and are elastically deformed inside, so that the engagement projections 33 are allowed to be fit into the engagement openings 41*a*. In this case, since a guide slanted surface 43*a* is also formed at each of the abutment portions of the flexible engagement pieces 43, the press contact terminals 26 can be inserted smoothly.

As shown in FIG. 6B, when the press contact terminal 26 is pushed into the common terminal chamber 28 and the flexible engagement pieces 43 move over the engagement projections 33, the flexible engagement pieces 43 engage with the horizontal surfaces 33*b* of the engagement projections 33 due to the elastic restoring force and so the press contact terminal 26 is prevented from coming out upward.

The engagement projections 33 are fitted into the engagement openings 41*a* from the terminal bottom wall 25*e* side and caught at the opening edge, so that the press contact terminal 26 is positioned in the axis line direction.

In FIG. 6, although the explanation has been made as to the case where the press contact terminal 26 is inserted from the upper opening of the common terminal chamber 28 of the insulation housing 23, the configuration of the housing engaging portion 41 of the crimped terminal 25 is similar to that of the press contact terminal and the crimped terminal-can be housed and held in the similar manner as the press contact terminal.

That is, according to the connector 21 of the first embodiment, the crimped terminal 25 or the press contact terminal 26 is inserted from the upper opening of the common terminal chamber 28.

Figure 10:
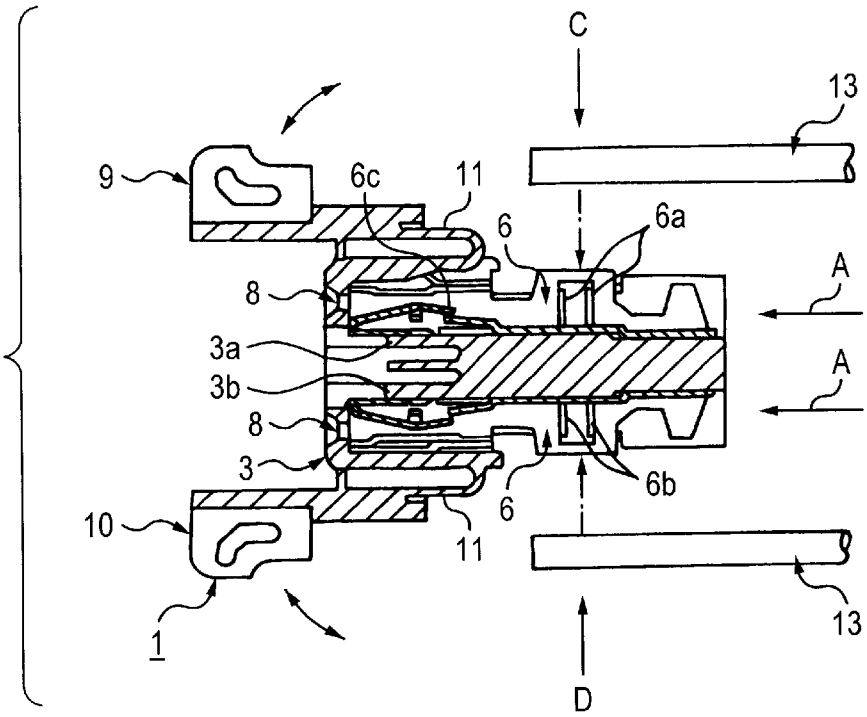
FIG. 10 is a longitudinal sectional view for explaining the attachment operation of the press contact terminal to the common terminal chamber of the insulation housing shown in FIG. 9.
Figure 11:
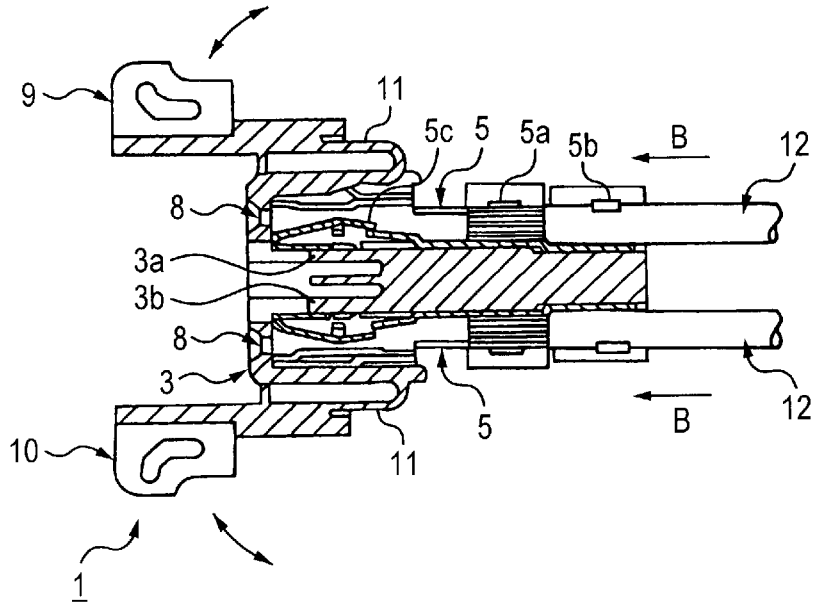
FIG. 11 is a longitudinal sectional view for explaining the attachment operation of the press contact terminal to the common terminal chamber of the insulation housing shown in FIG. 9.

Thus, when compared with the conventional connector 1 as shown in FIGS. 10 and 11 in which the crimped terminal 5 or the press contact terminal 6 is inserted within the common terminal chamber 8 from the rear side along the longitudinal direction of the terminal, according to the embodiment, the size of the opening is large and so the terminals 25, 26 can be inserted easily through the openings. Thus, the insertion operation of the terminals can be completed quickly without causing collision etc. between the front end portions of the terminals and the partition walls 29 due to the vibration of the terminals 25, 26 upon insertion thereof.

Further, the insertion direction of the crimped terminals 25 or the press contact terminals 26 with respect to the common terminal chambers 28 coincides with the direction of the press-contact operation of the covered electric wires 13 with respect to the press contact terminals 26. Thus, it is easy to automate a mounting process of the terminals 25, 26 on the insulation housing 23 and a press-contact process of the covered electric wires 13 with respect to the press contact terminals 26.

Thus, according to the connector 21 of the first embodiment, the crimped terminals 25 and the press contact terminals 26 can be housed in a mixed state, and the workability of the inserting operation of the respective terminals 25, 26 within the common terminal chambers 28 can be enhanced to improve the workability of the assembling operation of the connector 21 thereby to reduce a cost of the connector.

Further, at each of the both surfaces of each of the partition walls 29 defining and forming the common terminal chambers 28 of the insulation housing 23, the engagement projection 33 serving as the terminal engaging portion is protrusively provided which engages with the housing engaging portion 41 of the crimped terminal 25 or the press contact terminal 26 inserted from the upper opening of the common terminal chamber 28 thereby to position the terminal in the axis line direction.

Thus, after the press contact terminal 26 is housed within the common terminal chamber 28, the terminal is prevented from being deviated in its position at the time of the press-contact process of contacting the covered electric wire 13 with a pressure between a pair of the press-contact blades 26*a*, 26*a* at the rear end portion of the terminal. Further, since the housing engaging portions 41 are provisionally engaged with the engagement projections 33, the terminals 25, 26 housed within the common terminal chambers 28 are prevented from coming out until the terminals are covered by the insulation housing 23 at the upper stage and the cover member 31 laminated on the insulation housing 23 at the lower stage.

In the conventional connector, for example, in order to engage the housed terminal within the terminal housing portion, the engagement lance raised at the terminal is engaged with a recess portion formed at the inner wall surface of the terminal housing portion of the insulation housing and the flexible lance formed at the inner wall surface of the terminal housing portion is engaged with the opening formed at the terminal. In contrast, in the insulation housing 23, the engagement projection 33 of a small size and simple shape is merely provided protrusively at each of the both surfaces of each of the partition walls 29.

Thus, it is possible to make the pitch of the common terminal chambers 28 narrower by thinning the thickness of each of the partition walls 29 defining the respective common terminal chambers 28 and so the multi-pole connector can be miniaturized easily.

The tensile force acting through the covered electric wires 12, 13 coupled to the terminals 25, 26 can be received by the hooking portions between the engagement projections 33 protrusively provided at the partition walls 29 and the opening edges of the engagement openings 41*a* into which the engagement projections 33 are fitted.

Thus, as compared with the conventional engagement lance and flexible lance, the sufficient terminal engagement force can be easily secured for the insulation housing 23 and so the efficiency for housing and holding the terminals 25, 26 at the common terminal chambers 28 can be improved.

Further, since the flexible engagement pieces 43 do not protrude outside of the terminal side walls 25*d* (26*d*) of the terminals 25, 26, there is no possibility that the flexible engagement pieces 43 are caught by other terminals or other members etc. and damaged during the transportation of the terminals 25, 26. Thus, the connector according to the embodiment can be treated easily.

According to the connector of the invention, the configurations of the insulation housing 23, the crimped terminal 25, the press contact terminal 26 and the cover member 31 are not limited to those of the aforesaid embodiment, and, of course, may take various kinds of modification based on the gist of the invention.

For example, each of the crimped terminal 25 and the press contact terminal 26 of the aforesaid embodiment may be a female terminal or a male terminal.

Figure 7:
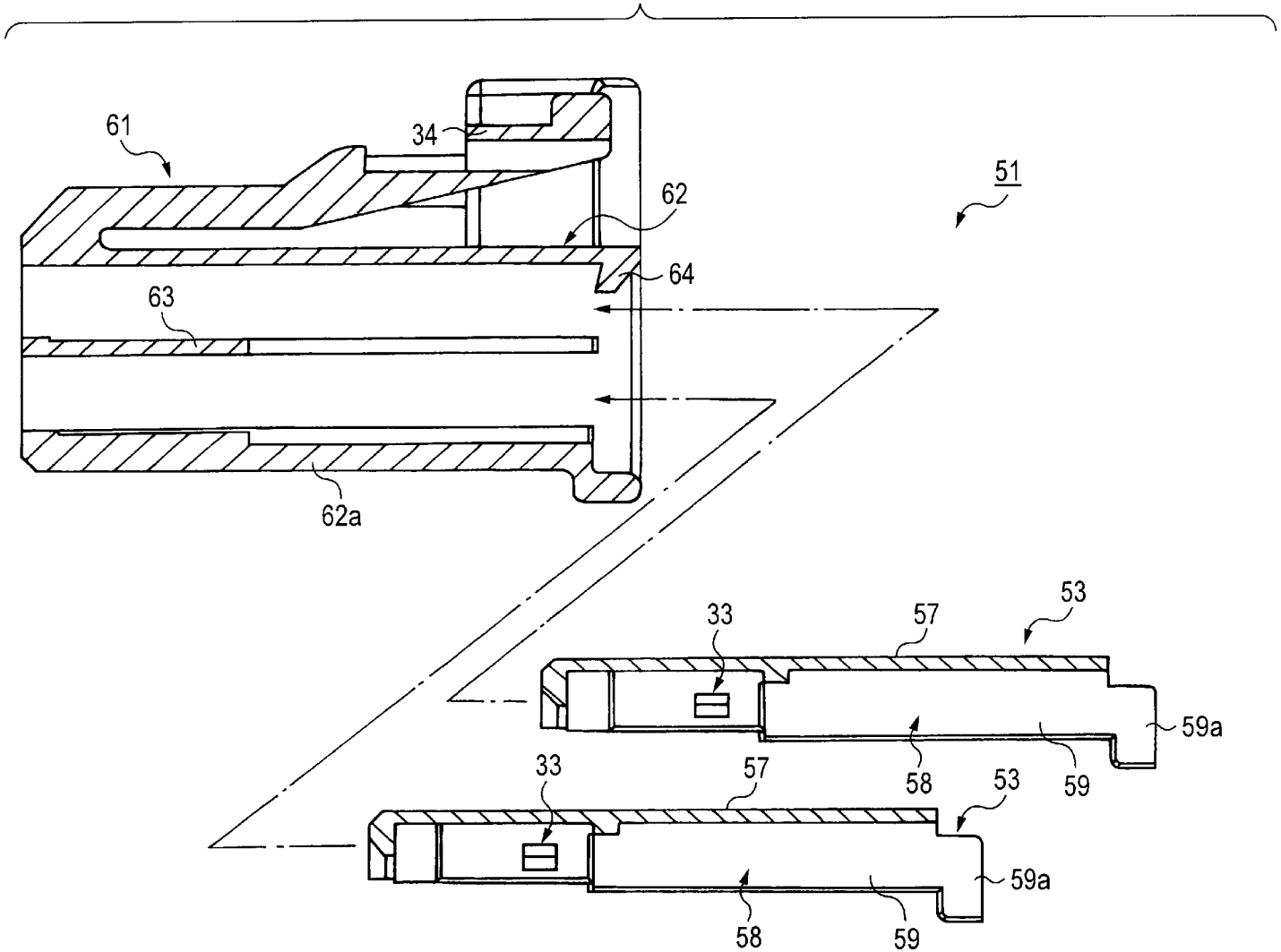
FIG. 7 is an exploded perspective view of the connector according to the second embodiment of the invention.
Figure 8:
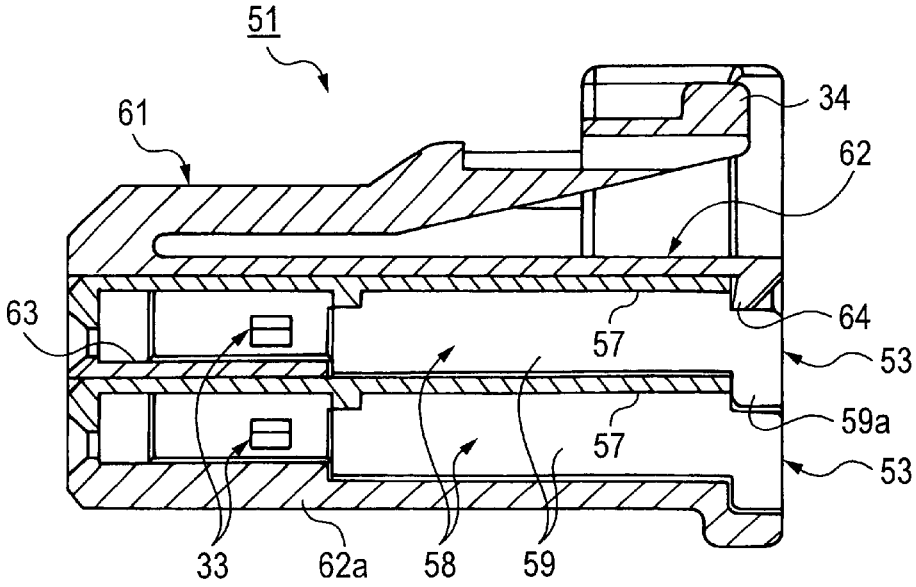
FIG. 8 is a perspective view of the connector in an assembled state shown in FIG. 7.
Figure 9:
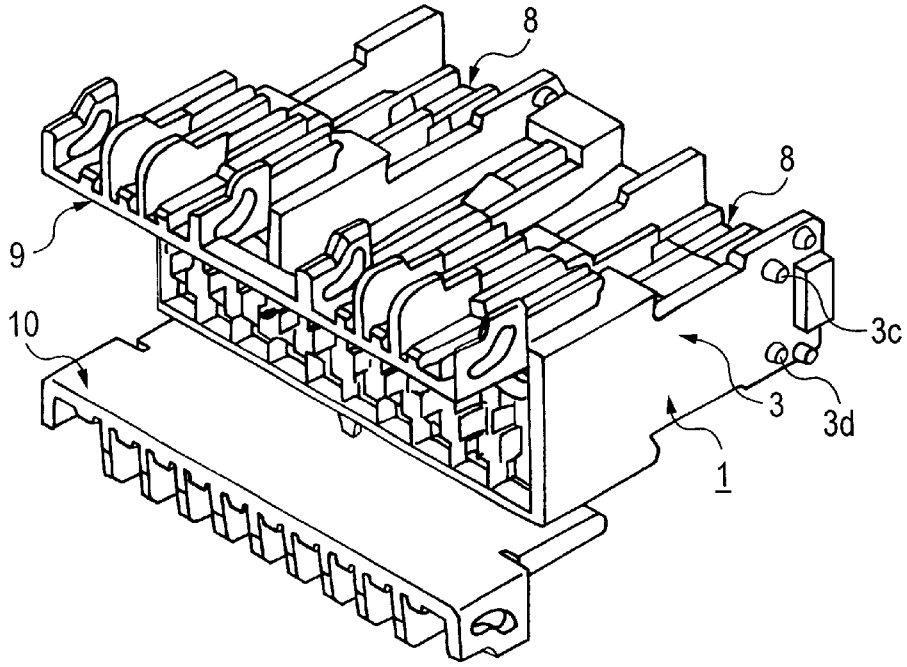
FIG. 9 is a perspective view showing an entirety of the insulation housing of a conventional connector in which crimped terminals and press contact terminals are housed in a mixed manner.

FIGS. 7 and 8 is an exploded sectional view and an assembled sectional view of a connector according to a second embodiment of the invention.

Like the connector 21 according to the first embodiment, the connector 51 according to the second embodiment shown in FIGS. 7 and 8 is configured in a manner that two stages of insulation housings 53 are disposed therein each of which is additionally provided with common terminal chambers 58 each capable of housing a crimp-style terminal or a crimped terminal 25 or a press contact terminal 26 thereby to house the crimped terminals 25 and the press contact terminals 26 in a mixed manner within the connector. Incidentally, like parts corresponding to those of the connector 21 of the first embodiment are marked with the same references and therefore detailed explanation thereof is omitted.

The insulation housing 53 according to the second embodiment is configured in a manner that the common terminal chambers 58 are defined and formed by partition walls 59 which are erected with a predetermined interval on a lengthy base plate portion 57 and the crimped terminal 25 or the press contact terminal 26 (not shown) is inserted from an upper opening of each of the common terminal chambers 58.

At each of the both surfaces of each of the partition walls 59 of the insulation housing 53, an engagement projection 33 serving as a terminal engaging portion is protrusively provided which acts to position the terminal in the axis line direction. An engagement convex portion 59*a* is provided so as to be extended from the rear end portion of each of the partition walls 59 of the insulation housing 53.

Like the insulation housing 23 of the first embodiment, the insulation housing 53 is also integrally formed continuously in a lengthy manner along the arrangement direction of the common terminal chambers 58 in advance and thereafter cut at use into a predetermined length in accordance with a required number of poles.

A cover member 61 of the second embodiment is not configured to include the cover
main body 31*a* of an almost rectangular shape which only covers the upper openings of the common terminal chambers 28 of the insulation housing 23 at the upper stage, like the cover member 31 of the first embodiment, but is configured to include a cylindrical housing 62 which also covers the periphery of the insulation housings 53 piled up in a laminated state.

That is, as shown in FIG. 7, the cover member 61 includes the cylindrical housing 62 in which the insulation housings 53 are inserted from an opening at the rear end side (the right side in the figure) and a locking arm 34 provided at the upper surface of the cylindrical housing 62. A partition wall 63 for restricting the elevational position of the insulation housings 53 housed within the cylindrical housing is provided within the cylindrical housing 62.

Then, the insulation housings 53 are sequentially inserted within the cylindrical housing 62 from the lower stage side insulation housing.

As shown in FIG. 8, first, when the insulation housing 53 is inserted at the lower stage of the cylindrical housing 62, the rear end edge of the base plate portion 57 thereof is engaged with the engagement convex portion 59*a* of the insulation housing 53 inserted at the upper stage and so the insulation housing at the lower stage is prevented from coming out. Next, the insulation housing 53 inserted at the upper stage is engaged at the rear end edge of the base plate portion 57 thereof with an engagement projection 64 which is protrusively provided at the upper edge of an opening at the rear end side of the cylindrical housing 62 and so the insulation housing at the upper stage is prevented from coming out.

Thus, in the connector 51 of the second embodiment, the upper openings of the common terminal chambers 58 of the insulation housing 53 at the upper stage inserted within the cylindrical housing 62 of the cover member 61 are covered by the base plate portion 57 of the insulation housing 53 at the lower stage, and the upper openings of the common terminal chambers 58 of the insulation housing 53 at the lower stage are covered by the bottom wall 62*a* of the cylindrical housing 62.

Thus, like the connector 21 of the first embodiment, according to the connector 51 of the second embodiment, also, the crimped terminals 25 and the press contact terminals 26 can be housed in a mixed state, and the workability of the inserting operation of the respective terminals 25, 26 within the common terminal chambers 58 can be enhanced to improve the workability of the assembling operation of the connector 51 thereby to reduce a cost of the connector.

The connector 51 according to the second embodiment is configured in a manner that the two insulation housings 53 are piled up in a laminated state and housed within the cylindrical housing 62 thereby to provide the connector with the common terminal chambers 58 of multi-stages in the vertical direction. However, the connector may be configured in a manner that the single insulation housing 53 is arranged in a single stage or the insulation housings 53 are laminated in multi-stages of three stages or more.

According to the connector of the invention described above, the crimped terminal or the press contact terminal is inserted from the upper opening of the common terminal chamber.

Thus, when compared with the conventional connector in which the crimped terminal or the press contact terminal is inserted within the common terminal chamber from the rear side opening along the longitudinal direction of the terminal, according to the connector of the invention, the size of the opening is large and so the terminals can be inserted easily through the openings. Thus, there does not arise such a phenomenon that the front end portion of the terminal collides with the inner wall of the common terminal chamber due to the vibration of the terminal upon insertion thereof.

Further, the insertion direction of the crimped terminals or the press contact terminals with respect to the common terminal chambers coincides with the direction of the press-contact operation of the covered electric wires with respect to the press contact terminals. Thus, it is easy to automate the mounting process of the respective terminals on the insulation housing and the press-contact process of the covered electric wires with respect to the press contact terminals.

Thus, the crimped terminals and the press contact terminals can be housed in a mixed states and the workability of the inserting operation of the respective terminals within the common terminal chambers can be enhanced to improve the workability of the assembling operation of the connector thereby to reduce a cost of the connector.

What is claimed is:

1. A connector system, comprising:

a plurality of crimped terminals, wherein each crimped terminal includes a female terminal fitting portion at one end and at least one caulking nail for caulking with an uncovered wire;

a plurality of press contact terminals, wherein each terminal includes a female terminal fitting portion at one end and at least one press-contact blade at a rear portion of the press contact terminal which cuts an outer cover of a covered electric wire and is made in contact with an inner conductor of the conductive wire;

a connector, including plural stages of insulation housings, each of which includes a base plate portion and partition walls which are erected from the base plate portion, thereby forming a plurality of common terminal chambers;

each of the common terminal chambers being configured to be capable of accommodating and engaging with one of the plurality of crimped terminals and capable of accommodating and engaging with one of the plurality of press contact terminals;

wherein the crimped terminals and the press contact terminals are accommodated in a mixed manner within each of the insulating housings;

wherein openings of the common terminal chambers through which the crimped terminal or the press contact terminal is inserted are formed on one side surface of each of said insulating housings; and wherein the insulation housings are stacked and a cover is provided on one of the insulating housings at an end of stacking of the insulating housings so as to cover on side of one of said insulating housings.

2. A connector system according to claim 1, wherein each of the partition walls of the insulation housings is provided with a terminal engaging portion which engages with a housing engaging portion of the crimped terminal or the press contact terminal inserted from an upper opening of each of the common terminal chambers to position the terminal in an axis line direction.

3. A connector system according to claim 2, wherein the housing engaging portion includes an engagement opening formed at a side wall of each of the terminals respectively opposing to the partition walls and a flexible engagement piece formed on a terminal bottom wall side of the engagement opening, and the terminal engaging portion is formed by an engagement projection protrusively provided at each of the partition walls in correspondence to the engagement opening.

4. The connector system according to claim 2, wherein the crimped terminal or the press contact terminal is inserted in a direction that coincides with a press contact direction of the press contact terminals.

5. The connector system according to claim 3, wherein the flexible engagement piece includes a slanting surface and the terminal engaging protrusion includes a slanting surface, and the flexible engagement piece is elastically deformed by the slanting surface of the terminal engaging protrusion so that the terminal engaging protrusion is fitted into the engagement opening.

6. The connector system according to claim 5, wherein the terminal engaging protrusion includes a horizontal surface that engages the flexible engagement piece so as to secure the terminal.

* * * * *